United States Patent [19]

Hill et al.

[11] Patent Number: 5,025,815

[45] Date of Patent: Jun. 25, 1991

[54] POLYOLEFIN FILTER TOW AND METHOD OF MAKING IT

[75] Inventors: Michael Hill, Ascot, England; Walter A. Nichols, Richmond, Va.

[73] Assignee: Filter Materials Limited, New York, N.Y.

[21] Appl. No.: 231,147

[22] Filed: Aug. 10, 1988

[51] Int. Cl.[5] ..... A24D 3/06

[52] U.S. Cl. ..... 131/332; 131/331

[58] Field of Search ..... 131/332, 331

[56] References Cited

U.S. PATENT DOCUMENTS

| | | | |
|---|---|---|---|
| 3,494,522 | 2/1970 | Kim et al. | 225/97 |
| 3,495,752 | 2/1970 | Kim et al. | 225/3 |
| 3,496,260 | 2/1970 | Guenther et al. | 264/156 |
| 3,500,517 | 3/1970 | Dekker et al. | 28/1.5 |
| 3,500,627 | 3/1970 | Kim | 57/140 |
| 3,526,349 | 9/1970 | Moro | 225/97 |
| 3,565,308 | 2/1971 | Slack | 225/97 |
| 3,566,735 | 3/1971 | Greene | 83/334 |
| 3,577,724 | 5/1971 | Greene | 57/157 |
| 3,595,454 | 7/1971 | Kalwaites | 225/3 |
| 3,726,079 | 4/1973 | Feild et al. | 57/155 |
| 3,739,053 | 6/1973 | Yazawa | 264/154 |
| 3,756,484 | 9/1973 | Guenther | 225/97 |
| 3,787,261 | 1/1974 | Heger et al. | 156/84 |
| 3,801,252 | 4/1974 | Waterhouse | 425/304 |
| 3,819,769 | 6/1974 | Pirot | 260/897 X |
| 3,835,513 | 9/1974 | Stanley | 28/72.14 |
| 3,880,173 | 4/1975 | Hill | 131/269 |
| 3,883,936 | 5/1975 | Stanley | 28/72.14 |
| 3,927,957 | 12/1975 | Chill et al. | 425/131.1 |
| 3,985,600 | 10/1976 | Blais | 156/229 |
| 3,985,933 | 10/1976 | Mehta et al. | 428/357 |
| 4,129,632 | 12/1978 | Olson et al. | 264/40.1 |
| 4,134,951 | 1/1979 | Dow et al. | 264/147 |
| 4,273,600 | 6/1981 | Luke | 156/180 |

FOREIGN PATENT DOCUMENTS

| | | |
|---|---|---|
| 2086258 | 12/1971 | France . |
| 120773 | 10/1970 | United Kingdom . |
| 1260957 | 1/1972 | United Kingdom . |
| 1315306 | 5/1973 | United Kingdom . |
| 1339496 | 12/1973 | United Kingdom . |

*Primary Examiner*—V. Millin

*Attorney, Agent, or Firm*—Jeffrey H. Ingerman

[57] ABSTRACT

A polyolefin material having improved fibrillation properties, allowing one to achieve higher yield in cigarette filters made from the fibrillated material is provided. The material includes between about 70% and about 99% of at least one polypropylene homopolymer with a melt index of between about 1.2 to about 3.0 (measured according to ISO standard 1133 at 230° C., 2.16 kgf) and a density of about 0.905 g/cc, and between about 1% and about 30% of at least one low density polyethylene homopolymer with a melt index of between about 0.9 and 3.0 (measured according to ISO standard 1133 at 190° C., 2.16 kgf) and a density of about 0.921 g/cc.

24 Claims, 1 Drawing Sheet

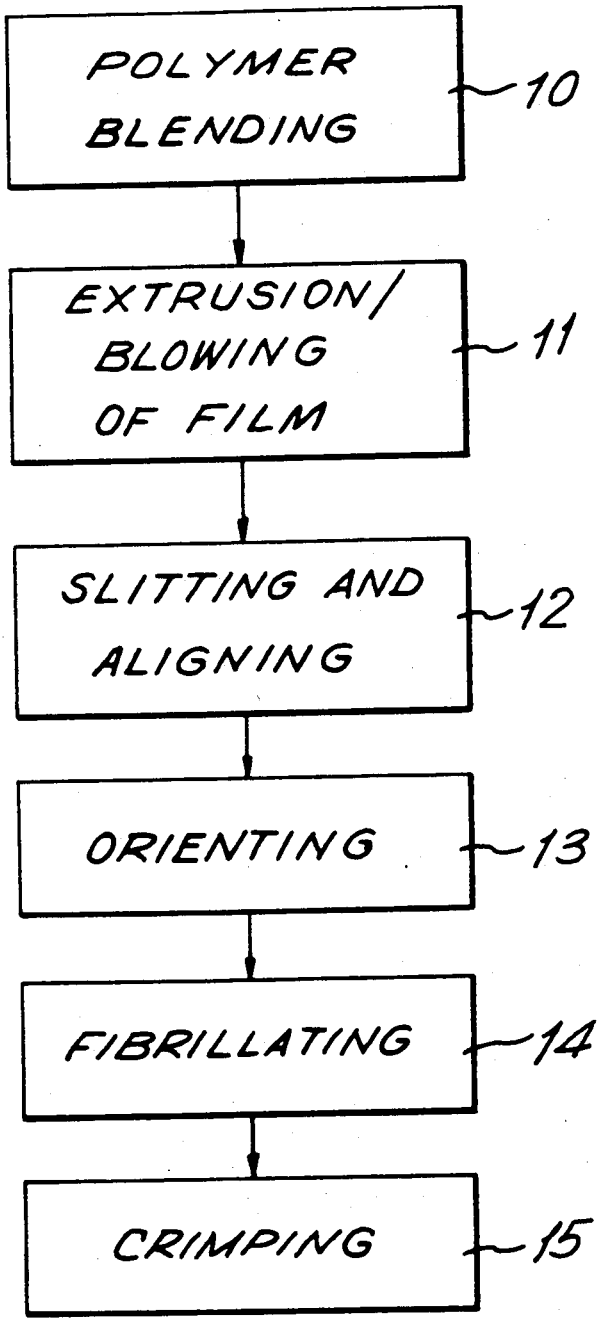
POLYMER BLENDING
10
EXTRUSION/ BLOWING OF FILM
11
SLITTING AND ALIGNING
12
ORIENTING
13
FIBRILLATING
14
CRIMPING
15

POLYOLEFIN FILTER TOW AND METHOD OF MAKING IT

BACKGROUND OF THE INVENTION

This invention relates to the manufacture of polyolefin tow for use in cigarette filters. In particular, this invention relates to an improved polyolefin filter tow and a method of making it.

It is known to produce polyolefin filter tow by stretching polyolefin film while heating it in order to orient its molecular structure in the stretching direction, slitting the film to fibrillate it, and then subjecting the fibrillated film to a crimping operation. Crimping the fibrillated film gives it more bulk, and makes it "fluff up" so that it is more like traditional cigarette filter materials, such as cellulose acetate. One such polyolefin filter tow and its manufacture are described in U.S. Pat. No. 3,880,173.

The oriented film is slit in the direction of orientation, because the film tends to "crack" in that direction, so that it is easy to slit, while in the transverse direction it becomes more difficult to slit. However, in some cases it becomes so easy to slit the film in the orientation direction that a slit once started may continue too far, perhaps even to the end of the film.

When fibrillated polyolefin film is made into filter tow, and cigarette filters are made from the tow, the tow has a certain "yield", defined as the pressure drop obtainable from a given weight of filter tow. Yield may by measured, for example, in millimeters of water per milligram (mm WG/mg). It is desirable to maximize the yield from a given weight of filter tow.

One way to maximize tow yield from fibrillated polyolefin film is to control the tendency of the oriented film to crack.

It would be desirable to be able to control the properties of polyolefin film so that it fibrillates as desired, thereby to improve the yield of filter tow produced therefrom.

SUMMARY OF THE INVENTION

It is an object of this invention to be able to control the properties of polyolefin film so that it fibrillates as desired, thereby to improve the yield of filter tow produced therefrom.

In accordance with this invention, there is provided a polyolefin filter tow, comprising between about 70% and about 99% of at least one polypropylene homopolymer with a melt index of between about 1.2 to about 3.0 and a density of about 0.905 g/cc, and between about 1% and about 30% of at least one low density polyethylene homopolymer with a melt index of between about 0.9 and 3.0 and a density of about 0.921 g/cc.

A method of making polyolefin filter tow is also provided. The method includes the following steps:

1. Forming a polyolefin film having a molecular structure, the polyolefin film comprising between about 70% and about 99% of at least one polypropylene homopolymer and between about 1% and about 30% of at least one low density polyethylene homopolymer.
2. Orienting the molecular structure by heating the film to just below its melting point and stretching the heated film.
3. Fibrillating the oriented film to form an interconnected fiber web.
4. Crimping the fibrillated web.

BRIEF DESCRIPTION OF THE DRAWING

The above and other objects and advantages of the invention will be apparent upon consideration of the following detailed description, taken in conjunction with the accompanying FIGURE, which is a flow diagram of the method according to the invention.

DETAILED DESCRIPTION OF THE INVENTION

The polyolefin filter tow of the present invention is made from a preferred blend of polyolefins. It has been found that filter tow with improved yield can be obtained from a polyolefin blend which includes between about 70% and about 99%, and preferably between about 90% and about 99%, of at least one polypropylene homopolymer with a melt index of between about 1.2 to about 3.0 and a density of about 0.905 g/cc, and between about 1% and about 10%, and preferably between about 1% and about 30%, of at least one polyethylene homopolymer with a melt index of between about 0.9 and 3.0 and a density of about 0.921 g/cc. A particularly preferred composition according to the invention includes polypropylene homopolymers with melt indices between about 1.8 and about 2.5, and polyethylene homopolymers with melt indices between about 1.0 and 2.0. Melt indices are measured according to ISO standard 1133 at 230° C. and 2.16 kgf for the polypropylene homoploymers and 190° C. and 2.16 kgf for the polyethylene homopolymers. Low density polyethylene is particularly preferred in this invention, although high density or linear low density polyethylene can be used. Polystyrene may also be used in place of polyethylene as long as attention is paid to possible toxicological effects.

Although polypropylene alone is a particularly preferred material for cigarette filters, it has been found that polypropylene alone cracks too readily, so that slits formed in polypropylene film tend to propagate to the end of the film. The energy needed for crack propagation is much lower than that needed for crack initiation. Nevertheless, a crack will stop propagating if it reaches a point in the film which is irregular or dislocated, such as areas of atactic polypropylene, areas of noncrystalline material, areas with amorphous structure, or areas where the crystal structure is not oriented or where chain alignment has not occurred. Such dislocations can be introduced by adding high or low density polyethylene or linear low density polyethylene within the proportions stated, reducing slit propagation and giving rise to desirable increases in tow yield. Further, the stated melt indices reflect a rheology or viscosity which reduces the propensity of the formed film to crack.

In addition to the basic polymer composition, it has been found that the addition of crystalline fillers or other extenders to the composition improves the yield of filters made from the composition. It is believed that the addition of crystalline materials or other extenders increases the number of dislocations in the molecular structure of the film, decreasing the minimum distance between cracks and thereby allowing more, thinner fibers to be formed. In particular, addition of crystalline materials or other extenders increases the amount of free ends—fibers having only one point of attachment to the web—which improves the filtering characteristics of filters produced from the material. Suitable extenders include crystalline materials such as titanium dioxide, silica, and calcium carbonate, as well as carbon black and clay. These materials can also be used as colorants, particularly titanium dioxide (white) and carbon black (black), if it is desired to color the filters being made. A particularly preferred crystalline additive is titanium dioxide added at a rate of between about 0.15% and about 5.0% of total polymer mass. Titanium dioxide is preferred both because it gives the resulting filters a stark white appearance similar to conventional cellulose acetate filters and because it imparts good fibrillating properties resulting in improved yield. Other similar compounds, such as metal oxides and complexes thereof, may be used.

The extender materials can be added to the polymer composition in several ways. First, they can be mixed directly with the polymers. Second, they can be incorporated in a "masterbatch"—a material including one of the feedstock polymers and a relatively high proportion of the extender material—which can be blended to obtain the desired level of extender material in the overall composition. Third, they can be suspended or dissolved in a liquid carrier which is added to the polymers before or during extrusion into a film. Finally, the extender materials can be included in the polymers as purchased (or as otherwise prepared for film production).

The extender materials are preferably micronized—i.e., having a mean particle size distribution in the range of from about 0.10 micron to about 0.23 micron, and a mean particle size between about 0.14 micron and about 0.19 micron. They are also preferably at least 98% pure, nontoxic, and of food grade, suitable for extrusion.

A method of making filter tow in accordance with the invention is diagrammed in the FIGURE.

In polymer blending step 10, the polymers and other ingredients discussed above are blended.

A polyolefin film is blown, or extruded, in film blowing step 11, using, for example, a conventional film blower such as Extrusion Systems Ltd., Model 0100, which forms a cylindrical "bubble" of polyolefin film, having a thickness between about 20 microns and about 50 microns, and preferably about 35 microns. The film "bubble" is collapsed down to a flat two-layer configuration, and it then, in the preferred embodiment, is slit into, preferably, three two-layer bands which are aligned on top of one another to form one six-layer band in slitting and aligning step 12. The six-layer band is itself slit into two bands for parallel processing, allowing the simultaneous production of two tow batches with possibly different properties, if desired. In the discussion which follows, only the course of one of the two parallel bands will be discussed, the other band undergoing substantially the same treatment.

The six-layer band is then passed through orientation step 13, where it is preferably heated to about 160° C., just below its melting point, as it is stretched between two sets of rollers. The drawing set of rollers rotates at about 5–13 times the speed of the feeding rollers. This "orientation" process aligns the molecular structure of the film, creating the physical characteristics necessary for fibrillation. The film thickness is also decreased to between about 8 microns and about 17 microns, and preferably about 12.4 microns.

The oriented film band is then turned into fiber in fibrillation step 14 in which the film is contacted with a relatively large number of relatively fine pins set in one or more fibrillating rollers which rotate as the film passes over them. The film contacts only about 20–45 degrees of arc of each of the rollers, preferably about 37 degrees, and the speed of the film is about twice that of the surface of the fibrillating rollers. The ratio of film speed to fibrillation roller speed is known as the "fibrillation ratio." As a result of fibrillation, if the band is expanded laterally, an interconnected network of fibers would be apparent, with a certain proportion of free ends. As discussed above, the free ends play an important role in filtration in filters made from the fibrillated film, and the higher the proportion of free ends, the better the filter.

After fibrillation, the fibrillated tow is crimped in crimping step 15, preferably in a stuffer box crimper in which the fibrillated film is fed by rolls at high speed into a closed box, causing it to collapse against tow material already present in the box. Crimping, at least by a stuffer box, imparts both "primary" and "secondary" crimp. Primary crimp is the crimp on the fibers themselves, which is on the order of about 25–60 crimps per inch with a crimp amplitude of about 300–600 microns, while secondary crimp is an accordion-like folding of the band as a whole. Primary crimp is desirable, while secondary crimp must be removed before filters are made from the tow.

Once crimped, the tow may be baled for later use, or may be made directly into filters.

The advantages provided by the polyolefin film of the invention are illustrated in the following examples:

EXAMPLE 1 (PRIOR ART)

A copolymer of propylene and ethylene having a melt index of 0.8 (including 20% copolymerized ethylene) was extruded using a known blown film technique to produce a film of 37 microns in thickness. This film was slit into 6 portions of equal width, stacked and oriented in a longitudinal direction with a stretch ratio of 7:1 to produce films of 14 microns in thickness. The oriented films were passed around part of the periphery of a pinned fibrillating roller under the following conditions:

| | |
|---|---|
| Fibrillator roller diameter (mm) | 203 |
| Pins in space staggered relationships in pairs of parallel rows extending across the roller on lines inclined to lines parallel to the roller axis, immediately adjacent pairs of rows being oppositely inclined: | |
| Number of rows of pins | 180 |
| Pin density each row | 25 pins per inch (ppi) |
| Angle of rake of pins (angle of pins to tangent to roller in opposite direction to that of roller rotation) | 60° |
| Pin projection | 1 mm |
| Pin diameter | 0.3683 mm |
| Arc of contact of film with roller | 45° |
| Film input speed | 63.6 m/min |
| Surface speed of fibrillator rolls (Fibrillation ratio of 2.5:1) | 159 m/min |

The fibrillated films so produced had a total linear density of 40,000 denier and were submitted to a stuffer box crimping operation.

The textured fiber tow so produced was submitted to a decrimping operation in a known manner producing a bloomed flocculent mass, the crimp frequency of which was 16 crimps per inch (cpi).

On making this material up into filter rods using conventional filter rod making equipment, filter rods with the following properties were produced:

| | |
|---|---|
| Filter rod length: 15 mm | |
| Net weight of fibrillated fiber tow per rod (mg) | 72 |
| Pressure drop across filter rod at flow rate of 1050 ml/min (mm WG) | 42 |
| Yield (%) | 58 |

EXAMPLE 2

A blend comprising 92% polypropylene homopolymer having a melt index of b 1.8 (measured according to ISO standard 1133 at 230° C., 2.16 kgf), 7% low density polyethylene having a melt index of 1.0 (measured according to ISO standard 1133 at 190° C., 2.16 kgf), and 1% polypropylene masterbatch containing 25% by weight titanium dioxide (rutile grade, fine crystal structure) was extruded using a known blown film technique to produce a film of 35 microns in thickness. This film was slit into 6 portions of equal width, stacked and oriented in a longitudinal direction with a stretch ratio of 8:1 to produce films of 12.4 microns in thickness. The oriented films were passed around part of the periphery of a pinned fibrillating roller under the following conditions:

| | |
|---|---|
| Fibrillator roller diameter (mm) | 190 |
| Pins in space staggered relationships in pairs of parallel rows extending across the roller on lines inclined to lines parallel to the roller axis, immediately adjacent pairs of rows being oppositely inclined: | |
| Number of rows of pins | 180 |
| Pin density each row | 25 pins per inch (ppi) |
| Angle of rake of pins (angle of pins to tangent to roller in opposite direction to that of roller rotation) | 60° |
| Pin projection | 1 mm |
| Pin diameter | 0.4953 mm |
| Arc of contact of film with roller | 37° |
| Film input speed | 144 m/min |
| Surface speed of fibrillator rolls (Fibrillation ratio of 2.2:1) | 316 m/min |

The fibrillated films so produced had a total linear density of 38,000 denier and were submitted to a stuffer box crimping operation.

The textured fiber tow so produced was submitted to a decrimping operation in a known manner producing a bloomed flocculent mass, the crimp characteristics of which were 396 microns amplitude and 41 cpi frequency.

On making this material up into filter rods using conventional filter rod making equipment, filter rods with the following properties were produced:

| | Minimum Point | Maximum Point |
|---|---|---|
| Filter rod length: 66 mm | | |
| Filter rod circumference: 24.55 mm | | |
| Net weight of fibrillated fiber tow per rod (mg) | 287 | 326 |
| Pressure drop across filter rod at flow rate of 1050 ml/min (mm WG) | 186 | 247 |
| Yield (%) | 65 | 76 |

EXAMPLE 3

A blend comprising 92.6% polypropylene homopolymer having a melt index of 1.8 (measured according to ISO standard 1133 at 230° C., 2.16 kgf), 7% low density polyethylene having a melt index of 1.0 (measured according to ISO standard 1133 at 190° C., 2.16 kgf), and 0.4% liquid carrier colorant in which 0.25% titanium dioxide (rutile grade) was suspended was extruded using a known blown film technique to produce a film of 35 microns in thickness. This film was slit into 6 portions of equal width, stacked and oriented in a longitudinal direction with a stretch ratio of 8:1 to produce films of 12.4 microns in thickness. The oriented films were passed around part of the periphery of a pinned fibrillating roller under the following conditions:

| | |
|---|---|
| Fibrillator roller diameter (mm) | 190 |
| Pins in space staggered relationships in pairs of parallel rows extending across the roller on lines inclined to lines parallel to the roller axis, immediately adjacent pairs of rows being oppositely inclined: | |
| Number of rows of pins | 180 |
| Pin density each row | 25 pins per inch (ppi) |
| Angle of rake of pins (angle of pins to tangent to roller in opposite direction to that of roller rotation) | 60° |
| Pin projection | 1 mm |
| Pin diameter | 0.4953 mm |
| Arc of contact of film with roller | 37° |
| Film input speed | 144 m/min |
| Surface speed of fibrillator rolls (Fibrillation ratio of 1.8:1) | 259 m/min |

The fibrillated films so produced had a total linear density of 32,000 denier and were submitted to a stuffer box crimping operation.

The textured fiber tow so produced was submitted to a decrimping operation in a known manner producing a bloomed flocculent mass, the crimp characteristics of which were 396 microns amplitude and 45.2 cpi frequency.

On making this material up into filter rods using conventional filter rod making equipment, filter rods with the following properties were produced:

| | Minimum Point | Maximum Point |
|---|---|---|
| Filter rod length: 66 mm | | |
| Filter rod circumference: 24.55 mm | | |
| Net weight of fibrillated fiber tow per rod (mg) | 263 | 289 |
| Pressure drop across filter rod at flow rate of 1050 ml/min (mm WG) | 161 | 198 |
| Yield (%) | 61 | 69 |

EXAMPLE 4

A blend comprising 91% polypropylene homopolymer having a melt index of 1.8 (measured according to ISO standard 1133 at 230° C., 2.16 kgf), 7% low density polyethylene having a melt index of 1.0 (measured according to ISO standard 1133 at 190° C., 2.16 kgf), and 2.0% liquid carrier colorant in which 1% carbon black was suspended was extruded using a known blown film technique to produce a film of 35 microns in thickness. This film was slit into 6 portions of equal width, stacked and oriented in a longitudinal direction with a stretch ratio of 8:1 to produce films of 12.4 microns in thickness. The oriented films were passed around part of the periphery of a pinned fibrillating roller under the following conditions:

| | |
|---|---|
| Fibrillator roller diameter (mm) | 190 |
| Pins in space staggered relationships in pairs of parallel rows extending across the roller on lines inclined to lines parallel to the roller axis, immediately adjacent pairs of rows being oppositely inclined: | |
| Number of rows of pins | 180 |
| Pin density each row | 25 pins per inch (ppi) |
| Angle of rake of pins (angle of pins to tangent to roller in opposite direction to that of roller rotation) | 60° |
| Pin projection | 1 mm |
| Pin diameter | 0.4953 mm |
| Arc of contact of film with roller | 37° |
| Film input speed | 144 m/min |
| Surface speed of fibrillator rolls (Fibrillation ratio of 1.8:1) | 259 m/min |

The fibrillated films so produced had a total linear density of 32,000 denier and were submitted to a stuffer box crimping operation.

The textured fiber tow so produced was submitted to a decrimping operation in a known manner producing a bloomed flocculent mass, the crimp characteristics of which were 308 microns amplitude and 38.4 cpi frequency.

On making this material up into filter rods using conventional filter rod making equipment, filter rods with the following properties were produced:

| | Minimum Point | Maximum Point |
|---|---|---|
| Filter rod length: 66 mm | | |
| Filter rod circumference: 24.55 mm | | |
| Net weight of fibrillated fiber tow per rod (mg) | 282 | 304 |
| Pressure drop across filter rod at flow rate of 1050 ml/min (mm WG) | 188 | 251 |
| Yield (%) | 67 | 83 |

EXAMPLE 5

A blend comprising 92% polypropylene homopolymer having a melt index of 2.3 (measured according to ISO standard 1133 at 230° C., 2.16 kgf), 7% low density polyethylene having a melt index of 1.0 (measured according to ISO standard 1133 at 190° C., 2.16 kgf), and 1% low density polyethylene masterbatch containing 25% by weight titanium dioxide (rutile grade, microcrystalline structure) was extruded using a known blown film technique to produce a film of 35 microns in thickness. This film was slit into 6 portions of equal width, stacked and oriented in a longitudinal direction with a stretch ratio of 8:1 to produce films of 12.4 microns in thickness. The oriented films were passed around part of the periphery of a pinned fibrillating roller under the following conditions:

| | |
|---|---|
| Fibrillator roller diameter (mm) | 190 |
| Pins in space staggered relationships in pairs of parallel rows extending across the roller on lines inclined to lines parallel to the roller axis, immediately adjacent pairs of rows being oppositely inclined: | |
| Number of rows of pins | 180 |
| Pin density each row | 25 pins per inch (ppi) |
| Angle of rake of pins (angle of pins to tangent to roller in opposite direction to that of roller rotation) | 60° |
| Pin projection | 1 mm |
| Pin diameter | 0.4953 mm |
| Arc of contact of film with roller | 37° |
| Film input speed | 144 m/min |
| Surface speed of fibrillator rolls (Fibrillation ratio of 2.0:1) | 288 m/min |

The fibrillated films so produced had a total linear density of 40,000 denier and were submitted to a stuffer box crimping operation.

The textured fiber tow so produced was submitted to a decrimping operation in a known manner producing a bloomed flocculent mass, the crimp characteristics of which were 452 microns amplitude and 54.9 cpi frequency.

On making this material up into filter rods using conventional filter rod making equipment, filter rods with the following properties were produced:

| | Minimum Point | Maximum Point |
|---|---|---|
| Filter rod length: 66 mm | | |
| Filter rod circumference: 24.55 mm | | |
| Net weight of fibrillated fiber tow per rod (mg) | 342 | 378 |
| Pressure drop across filter rod at flow rate of 1050 ml/min (mm WG) | 275 | 349 |
| Yield (%) | 80 | 92 |

EXAMPLE 6

A blend comprising 90.75% polypropylene homopolymer having a melt index of 1.8 (measured according to ISO standard 1133 at 230° C., 2.16 kgf), 7% low density polyethylene having a melt index of 1.0 (measured according to ISO standard 1133 at 190° C., 2.16 kgf), 1% polypropylene masterbatch containing 25% by weight titanium dioxide, and 1.25% polypropylene masterbatch containing 80.0% by weight calcium carbonate was extruded using a known blown film technique to produce a film of 35 microns in thickness. This film was slit into 6 portions of equal width, stacked and oriented in a longitudinal direction with a stretch ratio of 8:1 to produce films of 12.4 microns in thickness. The oriented films were passed around part of the periphery of a pinned fibrillating roller under the following conditions:

| | |
|---|---|
| Fibrillator roller diameter (mm) | 190 |
| Pins in space staggered relationships in pairs of parallel rows extending across the roller on lines inclined to lines parallel to the roller axis, immediately adjacent pairs of rows being oppositely inclined: | |
| Number of rows of pins | 180 |
| Pin density each row | 25 pins per inch (ppi) |
| Angle of rake of pins (angle of pins to tangent to roller in opposite direction to that of roller rotation) | 60° |
| Pin projection | 1 mm |
| Pin diameter | 0.4953 mm |

-continued

| | |
|---|---|
| Arc of contact of film with roller | 37° |
| Film input speed | 144 m/min |
| Surface speed of fibrillator rolls (Fibrillation ratio of 2.0:1) | 290 m/min |

The fibrillated films so produced had a total linear density of 36,500 denier and were submitted to a stuffer box crimping operation.

The textured fiber tow so produced was submitted to a decrimping operation in a known manner producing a bloomed flocculent mass, the crimp characteristics of which were 316 microns amplitude and 41.0 cpi frequency.

On making this material up into filter rods using conventional filter rod making equipment, filter rods with the following properties were produced:

| | Minimum Point | Maximum Point |
|---|---|---|
| Filter rod length: 66 mm | | |
| Filter rod circumference: 24.55 mm | | |
| Net weight of fibrillated fiber tow per rod (mg) | 304 | 355 |
| Pressure drop across filter rod at flow rate of 1050 ml/min (mm WG) | 199 | 292 |
| Yield (%) | 65 | 82 |

EXAMPLE 7

A blend comprising 88% polypropylene homopolymer having a melt index of 1.8 (measured according to ISO standard 1133 at 230° C., 2.16 kgf), 7% low density polyethylene having a melt index of 1.0 (measured according to ISO standard 1133 at 190° C., 2.16 kgf), and 5% liquid carrier in which 60.0% calcium carbonate and 5.0% titanium dioxide were suspended was extruded using a known blown film technique to produce a film of 35 microns in thickness. This film was slit into 6 portions of equal width, stacked and oriented in a longitudinal direction with a stretch ratio of 8:1 to produce films of 12.4 microns in thickness. The oriented films were passed around part of the periphery of a pinned fibrillating roller under the following conditions:

| | |
|---|---|
| Fibrillator roller diameter (mm) | 190 |
| Pins in space staggered relationships in pairs of parallel rows extending across the roller on lines inclined to lines parallel to the roller axis, immediately adjacent pairs of rows being oppositely inclined: | |
| Number of rows of pins | 180 |
| Pin density each row | 25 pins per inch (ppi) |
| Angle of rake of pins (angle of pins to tangent to roller in opposite direction to that of roller rotation) | 60° |
| Pin projection | 1 mm |
| Pin diameter | 0.4953 mm |
| Arc of contact of film with roller | 37° |
| Film input speed | 144 m/min |
| Surface speed of fibrillator rolls (Fibrillation ratio of 1.8:1) | 259 m/min |

The fibrillated films so produced had a total linear density of 32,000 denier and were submitted to a stuffer box crimping operation.

The textured fiber tow so produced was submitted to a decrimping operation in a known manner producing a bloomed flocculent mass, the crimp characteristics of which were 200 microns amplitude and 66.6 cpi frequency.

On making this material up into filter rods using conventional filter rod making equipment, filter rods with the following properties were produced:

| | Minimum Point | Maximum Point |
|---|---|---|
| Filter rod length: 66 mm | | |
| Filter rod circumference: 24.55 mm | | |
| Net weight of fibrillated fiber tow per rod (mg) | 277 | 288 |
| Pressure drop across filter rod at flow rate of 1050 ml/min (mm WG) | 171 | 188 |
| Yield (%) | 62 | 65 |

EXAMPLE 8

A blend comprising 92% polypropylene homopolymer having a melt index of 1.8 (measured according to ISO standard 1133 at 230° C., 2.16 kgf), 5.5% low density polyethylene having a melt index of 1.0 (measured according to ISO standard 1133 at 190° C., 2.16 kgf), and 2.5% polyethylene masterbatch in which 40% carbon black pigment was dispersed was extruded using a known blown film technique to produce a film of 35 microns in thickness. This film was slit into 6 portions of equal width, stacked and oriented in a longitudinal direction with a stretch ratio of 8:1 to produce films of 12.4 microns in thickness. The oriented films were passed around part of the periphery of a pinned fibrillating roller under the following conditions:

| | |
|---|---|
| Fibrillator roller diameter (mm) | 190 |
| Pins in space staggered relationships in pairs of parallel rows extending across the roller on lines inclined to lines parallel to the roller axis, immediately adjacent pairs of rows being oppositely inclined: | |
| Number of rows of pins | 180 |
| Pin density each row | 25 pins per inch (ppi) |
| Angle of rake of pins (angle of pins to tangent to roller in opposite direction to that of roller rotation) | 60° |
| Pin projection | 1 mm |
| Pin diameter | 0.4953 mm |
| Arc of contact of film with roller | 37° |
| Film input speed | 144 m/min |
| Surface speed of fibrillator rolls (Fibrillation ratio of 1.8:1) | 259 m/min |

The fibrillated films so produced had a total linear density of 32,000 denier and were submitted to a stuffer box crimping operation.

The textured fiber tow so produced was submitted to a decrimping operation in a known manner producing a bloomed flocculent mass, the crimp characteristics of which were 209 microns amplitude and 56.4 cpi frequency.

On making this material up into filter rods using conventional filter rod making equipment, filter rods with the following properties were produced:

| | Minimum Point | Maximum Point |
|---|---|---|
| Filter rod length: 66 mm | | |
| Filter rod circumference: 24.55 mm | | |
| Net weight of fibrillated fiber tow per rod (mg) | 275 | 314 |
| Pressure drop across filter rod at flow rate of 1050 ml/min (mm WG) | 173 | 221 |
| Yield (%) | 63 | 70 |

EXAMPLE 9

A blend comprising 91.75% polypropylene homopolymer having a melt index of 1.8 (measured according to ISO standard 1133 at 230° C., 2.16 kgf), 7% low density polyethylene having a melt index of 1.0 (measured according to ISO standard 1133 at 190° C., 2.16 kgf), and 1.25% polypropylene masterbatch in which 80% by weight of talc (silicon dioxide) was dispersed was extruded using a known blown film technique to produce a film of 35 microns in thickness. This film was slit into 6 portions of equal width, stacked and oriented in a longitudinal direction with a stretch ratio of 8:1 to produce films of 12.4 microns in thickness. The oriented films were passed around part of the periphery of a pinned fibrillating roller under the following conditions:

| | |
|---|---|
| Fibrillator roller diameter (mm) | 190 |
| Pins in space staggered relationships in pairs of parallel rows extending across the roller on lines inclined to lines parallel to the roller axis, immediately adjacent pairs of rows being oppositely inclined: | |
| Number of rows of pins | 180 |
| Pin density each row | 25 pins per inch (ppi) |
| Angle of rake of pins (angle of pins to tangent to roller in opposite direction to that of roller rotation) | 60° |
| Pin projection | 1 mm |
| Pin diameter | 0.4953 mm |
| Arc of contact of film with roller | 37° |
| Film input speed | 144 m/min |
| Surface speed of fibrillator rolls (Fibrillation ratio of 2.0:1) | 290 m/min |

The fibrillated films so produced were submitted to a stuffer box crimping operation.

The textured fiber tow so produced was submitted to a decrimping operation in a known manner producing a bloomed flocculent mass, the crimp characteristics of which were 332 microns amplitude and 28.0 cpi frequency.

On making this material up into filter rods using conventional filter rod making equipment, filter rods with the following properties were produced:

| | Minimum Point | Maximum Point |
|---|---|---|
| Filter rod length: 66 mm | | |
| Filter rod circumference: 24.55 mm | | |
| Net weight of fibrillated fiber tow per rod (mg) | 288 | 340 |
| Pressure drop across filter rod at flow rate of 1050 ml/min (mm WG) | 172 | 236 |
| Yield (%) | 60 | 69 |

Thus it seen that polyolefin film having desirable fibrillation properties is provided, which can be used to make fibrillated filter tow producing filters of improved yield. One skilled in the art will appreciate that the present invention can be practiced by other than the described embodiments, which are presented for purposes of illustration and not of limitation, and presented for purposes of illustration and not of limitation, and the present invention is limited only by the claims which follow.

What is claimed is:

1. A method of making a polyolefin filter tow, said method comprising, in the listed order, the steps of:

forming a polyolefin film having a molecular structure, said polyolefin film comprising between about 70% and about 99% of at least one polypropylene homopolymer, and between about 1% and about 30% of at least one low density polyethylene homopolymer;

orienting said molecular structure by heating said film to just below the melting point of said film and stretching said heated film;

fibrillating said oriented film to form an interconnected fiber web;

crimping said fibrillated web; and forming said crimped fibrillated web into filter tow, said filter tow having a yield of at least about 60%, said yield being defined as a dimensionless ratio of filter pressure drop expressed in millimeters of water to filter weight expressed in milligrams.

2. The method of claim 1 wherein said forming step comprises forming a polyolefin film comprising between about 90% and about 99% of said at least one polypropylene homopolymer and between about 1% and about 10% of said at least one low density polyethylene homopolymer.

3. The method of claim 1 wherein said forming step comprises forming a polyolefin film comprising at least one polypropylene homopolymer having a melt index between about 1.2 and about 3.0 (ISO 1133; 230° C., 2.16 kgf) and a density of about 0.905 g/cc, and at least one low density polyethylene homopolymer having a melt index between about 0.9 and about 3.0 (ISO 1133; 190° C., 2.16 kgf) and a density of about 0.921 g/cc.

4. The method of claim 3 wherein said forming step comprises forming a polyolefin film comprising at least one polypropylene homopolymer having a melt index between about 1.8 and about 2.5.

5. The method of claim 3 wherein said forming step comprises forming a polyolefin film comprising at least one low density polyethylene homopolymer having a melt index between about 1.0 and about 2.0.

6. The method of claim 1 wherein said forming step comprises forming a polyolefin film comprising between about 0.15% and about 5.0% of an extender.

7. The method of claim 1 wherein said forming step comprises forming a polyolefin film comprising between about 0.15% and about 5.0% of an extender which is a coloring agent.

8. The method of claim 7 wherein said forming step comprises forming a polyolefin film comprising between about 0.15% and about 5.0% of a material selected from the group consisting of titanium dioxide, carbon black, clay, calcium carbonate, silica, and mixtures thereof.

9. The method of claim 8 wherein said material is added to at least one of said polymers before said film is formed.

10. The method of claim 8 wherein said material is added in the form of a masterbatch.

11. The method of claim 8 wherein said material is added as part of a liquid carrier system.

12. The method of claim 8 wherein said material is blended directly with said homopolymers.

13. A polyolefin filter tow, comprising between about 70% and about 99% of at least one polypropylene homopolymer and between about 1% and about 30% of at least one low density polyethylene homopolymer, and having a yield of at least about 60%, said yield being defined as a dimensionless ratio of filter pressure drop expressed in millimeters of water to filter weight expressed in milligrams.

14. The filter tow of claim 13 comprising between about 90% and about 99% of said at least one polypropylene homopolymer and between about 1% and about 10% of said at least one low density polyethylene homopolymer.

15. The polyolefin filter tow of claim 13 wherein said at least one polypropylene homopolymer has a melt index between about 1.2 and about 3.0 (ISO 1133; 230° C., 2.16 kgf) and a density of about 0.905 g/cc, and said at least one low density polyethylene homopolymer has a melt index between about 0.9 and about 3.0 (ISO 1133; 190° C., 2.16 kgf) and a density of about 0.921 g/cc.

16. The polyolefin filter tow of claim 15 wherein said at least one polypropylene homopolymer has a melt index between about 1.8 and about 2.5.

17. The polyolefin filter tow of claim 15 wherein said at least one low density polyethylene homopolymer has a melt index between about 1.0 and about 2.0.

18. The polyolefin filter tow of claim 13 further comprising between about 0.15% and about 5.0% of an extender.

19. The polyolefin filter tow of claim 18 wherein said extender is a coloring agent.

20. The polyolefin filter tow of claim 19 wherein said extender is selected from the group consisting of titanium dioxide, carbon black, clay, calcium carbonate, silica, and mixtures thereof.

21. The method of claim 1 wherein said step of forming said crimped fibrillated web into said filter tow comprises forming said crimped fibrillated web into a filter tow having a minimum yield between about 60% and about 80%.

22. The method of claim 1 wherein said step of forming said crimped fibrillated web into said filter tow comprises forming said crimped fibrillated web into a filter tow having a maximum yield between about 65% and about 92%.

23. The polyolefin filter tow of claim 13, said filter tow having a minimum yield between about 60% and about 80%.

24. The polyolefin filter tow of claim 13, said filter tow having a maximum yield between about 65% and about 92%.

* * * * *